United States Patent [19]

Kretzmeir

[11] 4,167,264

[45] Sep. 11, 1979

[54] VISE CADDY TOOL RACK

[76] Inventor: James P. Kretzmeir, 2236 MacFarlane Dr., Woodland Hills, Calif. 91364

[21] Appl. No.: 925,035

[22] Filed: Jul. 17, 1978

[51] Int. Cl.[2] ..... B25B 5/16

[52] U.S. Cl. ..... 269/16

[58] Field of Search ..... 269/16, 15, 71; 211/60 T, 107, 110

[56] References Cited

U.S. PATENT DOCUMENTS

| | | | |
|---|---|---|---|
| 1,614,697 | 1/1927 | Snook | 269/16 X |
| 2,120,571 | 6/1938 | Reichenstein et al. | 269/16 X |
| 2,572,797 | 10/1951 | Zimmer | 211/60 T X |
| 3,737,131 | 6/1973 | Larson | 211/60 T X |

FOREIGN PATENT DOCUMENTS

| | | | |
|---|---|---|---|
| 815480 | 10/1951 | Fed. Rep. of Germany | 269/16 |

*Primary Examiner*—Robert C. Watson

*Attorney, Agent, or Firm*—Roger A. Marrs

[57] ABSTRACT

A tool rack or tool caddy is disclosed herein for conveniently holding a variety of tools utilized in the designing and construction of fishing flies and lures and equipment. The rack or caddy removably mounts on a vertical shaft of a conventional tool vise so as to be in close proximity to the working jaws thereof. The rack or caddy includes a mounting hole for slidably receiving the vise shaft and extends perpendicular therefrom. A selected side of the elongated rack includes a plurality of hooks for holding tools and the rack is provided with a plurality of apertures or holes for insertably holding additional tools. A multiplicity of vertical rods may be carried on the racks for rotatably supporting spools of thread, wire or the like.

4 Claims, 5 Drawing Figures

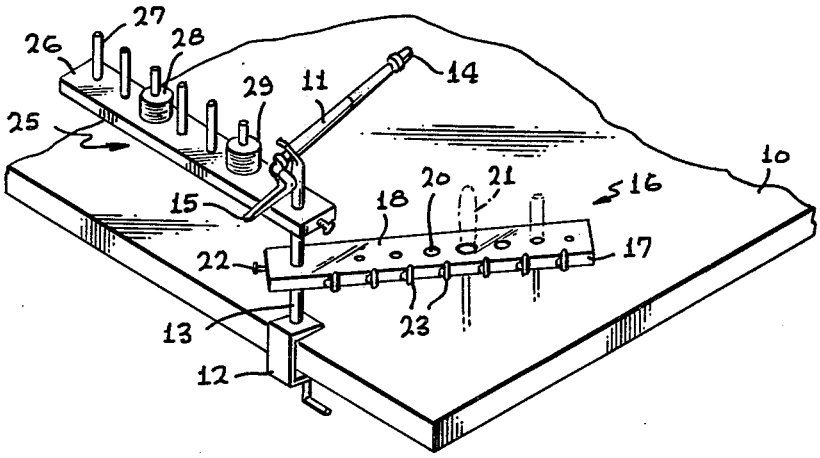
FIG. 1
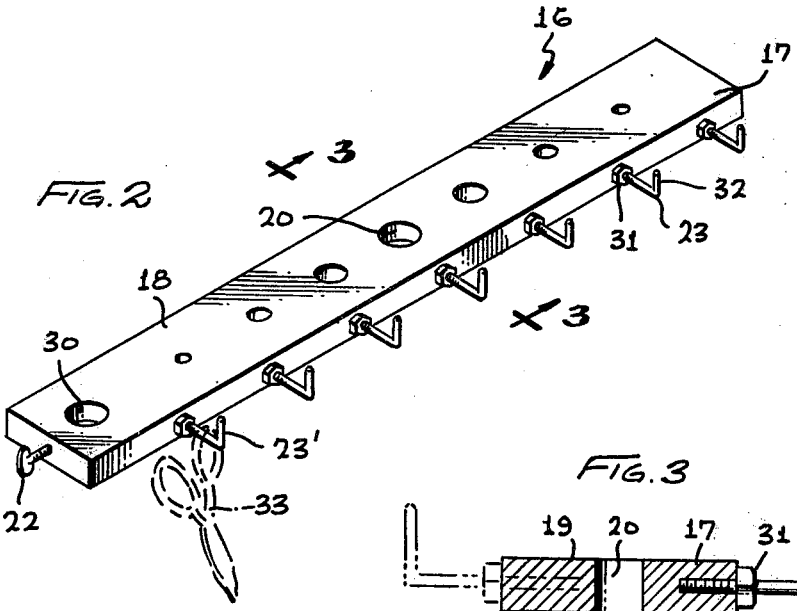
FIG. 2
FIG. 3
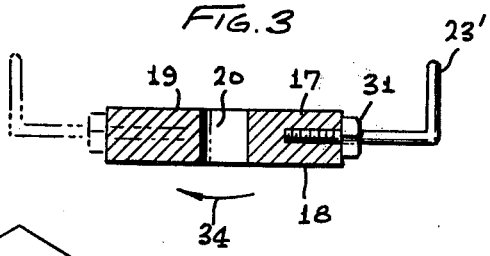
FIG. 5
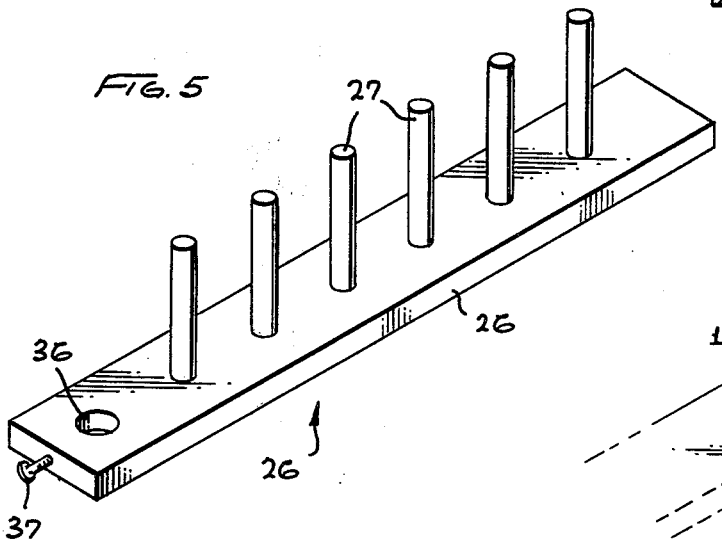
FIG. 4
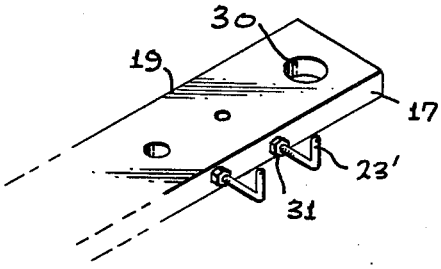

VISE CADDY TOOL RACK

BACKGROUND FOR THE INVENTION

1. Field of the Invention

This invention relates to tool storage devices and more particularly to a novel tool holder, rack or caddy for supporting a variety of hand tools normally utilized in the practice of making fishing lures or the like.

2. Brief Description of the Prior Art

It has been the conventional practice in the field of making fishing lures, small models, and other miniature or small handycraft items to employ a vise grip which is mounted on the edge of a table and employs a vertical shaft from which a locking jaw outwardly projects. The jaw comprises a pair of closure members or clamps which are intended to hold a work piece upon which a variety of operations or handycraft procedures are intended to take place. For example, in the field of making fishing lures, the jaws are intended to hold a hook while the user ties or twists a variety of feathers, fur, thread, wires or the like to the hook during the construction or building of a fishing lure. During the course of construction, the handycrafter employs a variety of hand tools such as scissors, screw drivers, picks, spools of thread, spools of wire or the like. Conventionally, it has been the practice to place these tools and materials on the table surface so that they will be available to the handycrafter during the construction procedures.

However, problems have been encountered when such a variety of tools and materials are dispersed on the table surface which stem largely from the fact that they are not in order and require the user to visually search or observe the layout of tools and materials so that he may select the proper implement or supply. Such a procedure leads to loss of concentration and requires the user to take his eyes off of the work being performed. In some instances, holders and stands have been provided to accommodate storage of the implements and supplies; however, the holders are generally located away from the work being performed and still require the user to remove his eyes from the work being performed so that he may inspect and grasp the selected implement or supply. Furthermore, such conventional holders are not a part of the vise and are not always available for right hand or left handed people.

Therefore, a long standing need has existed to provide a tool caddy or rack that may be readily mounted on the work piece vise for holding a variety of tools or implements as well as supplies of materials used by the handycrafter in the making of such products as fishing lures, small models or miniatures or the like.

SUMMARY OF THE INVENTION

Accordingly, the above problems and difficulties have been obviated by the present invention which provides a novel tool rack or caddy adapted to be mounted on a vise and which will accommodate storage of a plurality of various implements and supplies used in handycrafting a particular product. The caddy comprises an elongated base or member having opposite sides and ends. The caddy is provided with a plurality of aperatures or holes arranged along the central longitudinal plane between the opposite ends of the member which are adapted to receive a plurality of implements such as screw drivers, picks or the like. The diameters of the holes are intended to receive the shaft of the implement while the handle portion of the implement rests against the top surface of the member so that the implement will not pass through the hole. A selected side of the member includes a plurality of hook members or means which outwardly project in order to receive instruments such as scissors or the like for storage. Each hook means includes a releasable lock means for orienting the hook portion of the hook means in a given orientation so that the hooks may be arranged for right handed or left handed persons.

Another version of the invention resides in the provision of a plurality of vertical posts upwardly projecting from the surface of the base or member upon which the hole in a spool of thread or wire may be disposed so that the spool is rotatably supported on the top surface of the member.

Therefore, it is among the primary objects of the present invention to provide a novel tool caddy for use in combination with a work vice for supporting a variety of hand implements or tools and small quantities of materials.

Another object of the present invention is to provide a novel tool caddy having means for releasably supporting the caddy on a vise which includes means for supporting a variety of hand tools and work materials.

Still a further object of the present invention is to provide a novel base member including means for releasably supporting the member on the vertical shaft of a vice so that the member outwardly projects in close relationship to the jaws of the vise and wherein a variety of implements and tools may be carried thereon.

A further object of the present invention resides in the provisions of a tool caddy having means for supporting a variety of hand tools and implements so that they are convenient to both right handed and left handed persons.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view of a conventional vise grip incorporating the novel caddy or tool rack of the present invention;

FIG. 2 is an enlarged perspective view of the novel tool caddy or rack illustrating a plurality of hooks intended to be employed for carrying scissors or the like as well as tools such as screw drivers, picks or the like;

FIG. 3 is a transverse cross sectional view of the tool rack or caddy shown in FIG. 2 as taken in the direction of arrows 3—3 thereof;

FIG. 4 is a fragmentary perspective view of the tool rack shown in FIG. 2 having the hook means oriented so as to be available for left handed persons; and FIG. 5 is a perspective view of the tool rack incorporating a plurality of pegs or posts intended to rotatably receive spools of material.

DESCRIPTION OF PREFERRED EMBODIMENTS

Referring to FIG. 1, a work table 10 is illustrated having a conventional vise grip or clamp 11 carried thereon. The vice grip or clamp includes a screw type clamp 12 which holds the device on the edge of the table 10 for supporting an upright rod or shaft 13 so that a vise grip pair of jaws 14 project outwardly over the work surface of the table 10. The jaws 14 are intended to releasably hold a work piece intended to be worked on by the user. Releasing means 15 are employed for opening and closing the jaws 14.

The tool caddy of the present invention is indicated in the general direction of arrow 16 and includes an elongated base or member 17 having a top surface 18 through which a plurality of holes or aperatures, such as hole 20 is provided. Each of the holes are intended to receive a tool such as a screw driver 21 wherein the handle thereof rests on the top surface of the member 17 while the shaft or rod end of the tool downwardly projects through the hole. It is to be particularly noted that the plurality of the holes are in a line are arranged along the central plane of the member 17. Also, it is to be noted that the member 17 includes a releasable means 22 for releasably supporting the member on the shaft or rod 13. A plurality of hook means 23 are arranged along one side of the member 17 which are intended to receive other elements such as scissors, materials, cutting implements or the like.

Another version of caddy is illustrated in the direction of arrow 25 which includes a base or member 26 for supporting a plurality of posts or rods, such as indicated by numeral 27. In this instance, the posts are intended to rotatably support a variety of materials such as spools of wire 28 or thread 29.

Referring now in detail to FIG. 2, it can be seen that the member 17 includes a mounting hole 30 which is intended to be slipped over the shaft or rod 13 associated with the vise 11. For mounting purposes, the entire jaw and actuating assembly of the vise is removed from the clamp 12 and the caddy 17 is slipped onto the vise shaft 13. Once the rod 13 is inserted through fthe hole 30, the set screw 22 serving as a releasable lock means is tightened to hold the caddy at a desired position.

It is also to be noted that each of the hook means 23 includes a lock means indicated by numeral 31 which takes the form of a nut threadably carried on the shaft of the hook means 23. When the nut is tightened, it will bear against the side of the member 17 so that the hook means is retained in position so that the hook portion 32 faces upwardly. The mounting of an implement is indicated by numeral 33 with reference to the first hook means of the plurality indicated by the numeral 23. The hook means are oriented for right handed persons as shown in solid lines in FIGS. 2 and 3.

However, if it is desired to use the device in connection with left handed persons, the member 17 is rotated in the direction of arrow 34 so that the top surface 18 becomes the bottom surface. Then the nut 31 is backed off to release the hook means with respect to the member and the hook means is rotated so that the hook portion faces upwardly. Next, the nut 31 is tightened to maintain the hook in this position. It is to be noted that the normally underside surfacr 19 when used by a right handed person is now the top surface when used by a left handed person.

In FIG. 4, the left handed position is illustrated by hook means 23'.

Referring now in detail to FIG. 5, another version of the caddy is illustrated which provides the plurality of post 27 or receiving spools 28 and 29. The member 26 includes a mounting means 36 with a lock means 37 similar to the mounting and lock means 30 and 22 associated with the base or member 17. Both versions of the caddy may be used simultaneously such as suggested by the drawing in FIG. 1 or the caddys may be used independent of one another. Each of the plurality of posts or spindles 27 may be mounted on the top surface of the member 26 by threadable engagement with mating threads provided in holes in the top surface thereof.

In view of the foregoing, it can be seen that the novel device caddy tool rack of the present invention provides a novel means for holding a variety of implements and supplies normally used by a handycrafter in making small products. If the implement or tool includes eyelets, they may be mounted on the hooks 23 and if the implements include shafts and handles, they may be insertably disposed in any one of the holes 20. As previously described, the caddy may be employed for right handed or left handed persons in such a manner that the hook means including the implements mounted thereon will always be in an orientation facing the user and therefore ready for use.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A tool caddy for use with an upright vise having a vertical rod supporting a cantilevered set of vise jaws, the combination comprising:

an elongated base member having opposite sides and opposite ends;

means carried on a selected end of said base member for releasably mounting said base member on said vise vertical rod so as to cantilever outwardly therefrom beneath said set of vise jaws;

means carried on said base member for removably receiving and carrying a variety of work tools and work materials;

said releasable mounting means includes a hole provided in the edge marginal region of said selected base member end adapted to slidably receive said vise rod;

a manually operated screw threadably carried on said selected base member end engagable with said vise rod to clamp said base member to said vise rod in a desired position with respect to said set of vise jaws;

said work tool carrying and receiving means includes a plurality of upright posts carried on said base member in fixed spaced apart relationship along the central longitudinal plane of said base member in row;

each of said posts having a free end exposed to receive said work tools and said work material;

said work carrying and receiving means includes a plurality of holes of different diameters provided in said base member between said opposite ends in fixed spaced apart relationships adapted to insertably receive selected tools;

said base member further includes a plurality of hooks outwardly projecting from one side of said base member; and releasable means operably carried on each of said hooks for holding its associated hook in place on said base member.

2. The invention as defined in claim 1 wherein:

said hooks are rotatable with respect to said base member when not held by said releasable means so as to pivot upwardly to accomodate right or left handed persons.

3. The invention as defined in claim 2 wherein:

said releasable means is a lock nut.

4. A tool caddy for use with an upright vise having a vertical rod supporting a cantilevered set of vise jaws, the combination comprising:

an elongated base member having opposite sides and opposite ends;

means carried on a selected end of said base member for releasably mounting said base member on said vase vertical rod so as to cantilever outwardly therefrom beneath said set of vise jaws;

means carried on said base member for removably receiving and carrying a variety of work tools and work materials;

said work tool carrying and receiving means includes a plurality of upright posts carried on said base member in fixed spaced apart relationship along the central longitudinal plane of said base member in row;

each of said posts having a free end exposed to receive said work tools and said work material;

said base member further includes a plurality of hooks outwardly projecting from one side of said base member; and releasable means operably carried on each of said hooks for holding its associated hook in place on said base member.

* * * * *